US008098877B2

(12) United States Patent
Meyer

(10) Patent No.: US 8,098,877 B2
(45) Date of Patent: Jan. 17, 2012

(54) VIBRATION SPEAKER AND A PORTABLE ELECTRONIC DEVICE COMPRISING THE VIBRATION SPEAKER

(75) Inventor: Vincent Meyer, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 1061 days.

(21) Appl. No.: 11/961,246

(22) Filed: Dec. 20, 2007

(65) Prior Publication Data

US 2009/0136075 A1 May 28, 2009

Related U.S. Application Data

(60) Provisional application No. 60/990,000, filed on Nov. 26, 2007.

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 1/02* | (2006.01) |

(52) U.S. Cl. ..... 381/396; 381/392; 381/395

(58) Field of Classification Search ..... 381/396, 381/333, 388, 334, 386, 392, 395, 189, 401
See application file for complete search history.

(56) References Cited

U.S. PATENT DOCUMENTS 6,487,300 B1 11/2002 Lee et al.
2005/0180592 A1 * 8/2005 Miura ..... 381/401

* cited by examiner

*Primary Examiner* — Walter L Lindsay, Jr.
(74) *Attorney, Agent, or Firm* — Renner, Otto, Boisselle & Sklar, LLP

(57) ABSTRACT

A vibration speaker for a portable electronic device is disclosed herein. The vibration speaker comprises a case. A loudspeaker member for generating a sound is contained in the case. The loudspeaker member comprises a frame, a magnet, a voice coil and a membrane. The voice coil is operable to generate a movement of the membrane vertically up and down when an electric current is applied to the voice coil and a magnetic field is formed by interaction between the voice coil and the magnet. The vibration speaker additionally comprises a vibration coil for generating a vibration. The vibration coil is positioned in relation to the magnet of the loudspeaker member such that the vibration coil is operable to generate a movement of the entire loudspeaker member vertically up and down when an electric current is applied to the vibration coil and a magnetic field is formed by interaction between the vibration coil and the magnet. Metal springs may be positioned to elastically support between the loudspeaker member and the case.

11 Claims, 3 Drawing Sheets

VIBRATION SPEAKER AND A PORTABLE ELECTRONIC DEVICE COMPRISING THE VIBRATION SPEAKER

CROSS-REFERENCE TO RELATED APPLICATION

This application claims the benefit of U.S. Provisional Patent Application Ser. No. 60/990,000, filed Nov. 26, 2007, the entire disclosure of which is hereby incorporated by reference.

TECHNICAL FIELD

The present invention relates generally to a vibration speaker for a portable electronic device, e.g., a mobile phone. The vibration speaker is operable to combine a plurality of functions, e.g., a loudspeaker function, a vibration function and/or an accelerometer function.

BACKGROUND

Generally speaking, loudspeakers are sound-generating instruments that convert an electrical signal into sound. Loudspeakers which are applied in small-sized portable electronic devices such as mobile phones are sometimes referred to as micro speakers as their size is small. As small-sized portable electronic devices, e.g. mobile phones, are becoming more and more miniaturized, these micro speakers are also more and more miniaturized to adequately correspond to this ongoing trend of miniaturization.

FIG. 1 illustrates a state of the art micro speaker, which may be used in some existing portable electronic devices. This micro speaker is composed of a housing 1, a magnet 2 contained in the housing, a voice coil 3 and a membrane 4. The speaker generates sound as voice coil 3 moves vertically up and down owing to a magnetic field formed by the interaction between voice coil 3 and magnet 2 if electrical current is applied at voice coil 3 through lead wire from outside. As voice coil 3 moves up and down according to magnetic field variation applied at voice coil 3, the membrane 4 attached to the voice coil 3 vibrates up and down to generate sound. The micro speaker shown in FIG. 1 is only capable of providing a loudspeaker function.

Vibration means have recently been furnished at the same time together with the above-mentioned micro speaker in a portable electronic device to provide users with a vibration function in addition to the sound-generating function provided by the speaker. This way, users may be alerted not only by sound but also by vibration. The vibration means often used in the known prior art is a vibration motor. However, because there is a continuing need for miniaturization of portable electronic devices, the relatively bulky vibration motors may be undesirable in some applications. An alternative vibration speaker solution has been disclosed in U.S. Pat. No. 6,487,300 B1, which describes a vibration speaker contained in a portable communication instrument such as a mobile phone.

SUMMARY OF THE INVENTION

With the above and following description in mind, then, an aspect of the present invention is to provide an alternative vibration speaker which seeks to mitigate, alleviate or eliminate one or more of the above-identified deficiencies in the art and disadvantages singly or in any combination.

An aspect of the present invention relates to a vibration speaker for a portable electronic device, wherein the vibration speaker comprises a case; a loudspeaker member for generating a sound, the loudspeaker member being positioned inside the case and comprising a frame, a magnet, a voice coil and a membrane, wherein the voice coil is positioned to generate a movement of the membrane alternately in two opposite directions when an electric current is applied to the voice coil and a magnetic field is formed by interaction between the voice coil and the magnet; a vibration coil for generating a vibration, the vibration coil being positioned inside the case and further being positioned to generate a movement of the entire loudspeaker member alternately in the mentioned two opposite directions when an electric current is applied to the vibration coil and a magnetic field is formed by interaction between the vibration coil and the magnet, and at least one elastic member being positioned to elastically support between the loudspeaker member and the case when the entire loudspeaker member is moved alternately in the mentioned directions.

In one embodiment, the loudspeaker member is moveable alternately in the mentioned two opposite directions substantially at the same time as when said membrane moves alternately in said two opposite directions.

In one embodiment, the loudspeaker member is displaceable relative to the case when the loudspeaker member is moved alternately in the mentioned directions.

In one embodiment, the magnet is attached to a bottom side of the frame, an outside edge part of the membrane is affixed to a top part of the frame, and the voice coil is attached to the membrane.

In one embodiment, the at least one elastic member comprises a plurality of elastic members. The frame may be elastically mounted to the case by means of said plurality of elastic members. Suitably, the frame may be elastically mounted to both side walls and a bottom side of the case by means of said plurality of elastic members. The at least one elastic member may be made of a metal spring or a block of rubber.

In one embodiment, the frame of the loudspeaker member comprises a hole at the bottom side of the frame and the magnet is affixed to the frame at said hole.

In one embodiment, the magnet is a magnet having a cylindrical shape wherein a top part of the magnet is cylindrically affixed to the bottom side of the frame such that the magnet circumferentially surrounds the hole.

In one embodiment, the voice coil is a coil wound in cylindrical shape, which is wound on a bobbin whose top part is attached to a bottom surface of the membrane.

In one embodiment, the voice coil extends from the bottom surface of the membrane through a hollow interior of the loudspeaker member and through the hole of the frame, wherein the magnet and the voice coil are positioned to form a magnetic circuit together.

In one embodiment, the vibration speaker comprises a further magnet, the further magnet being attached to a bottom side of the case and being positioned underneath a hole of the bottom side of the frame such that the voice coil can be surrounded by a magnetic field formed by interaction between the voice coil and the combination of said magnet and said further magnet.

In one embodiment, the vibration coil is attached to a bottom side of the case and a top part of said vibration coil faces the bottom side of the frame of the loudspeaker member.

In one embodiment, the vibration coil is a coil wound in cylindrical shape, which is wound on a bobbin whose bottom part is attached to a bottom side of the case.

In one embodiment, the vibration speaker is electrically coupled to an accelerometer unit, which comprises: a voltage measuring unit adapted to measure a voltage across said vibration coil, the voltage across said vibration coil being representative of a displacement of the loudspeaker member relative to the case; and a comparator unit adapted to compare the measured voltage with predetermined voltage criteria for establishing whether the loudspeaker member is displaced relative to the case.

In one embodiment, said case is a hollow box type case

The different features of the above-mentioned vibration speaker can be combined in any combination.

Another aspect of the present invention relates to a portable electronic device, which comprises the vibration speaker as described above. The portable electronic device may suitably be a mobile phone.

Another aspect of the present invention relates to a vibration speaker for a portable electronic device according to the detailed description and the appended drawings. The vibration speaker may suitably be incorporated into a portable electronic device such as a mobile phone.

Some embodiments of the present invention provide a vibration speaker, which is smaller in size as compared to some state of the art solutions. Some embodiments of the invention are different from existing solutions inter alia in that they assume the use of the entire loudspeaker member (i.e. incl. the frame, the magnet, the membrane, and the voice coil) as the moving mass for the vibration coil to generate a vibration. It is an advantage with some embodiments of the invention that they provide a vibration speaker that may allow for a combined movement of both the membrane relative to the loudspeaker member as well as a movement of the entire loudspeaker member relative to the case of the vibration speaker. In turn, this may allow for an extension of the possible displacement range of the voice coil of the loudspeaker member. This may allow for an enhanced response in the bass register, where some state of the art solutions generally do not reproduce deep sound. Moreover, some embodiments of the invention provide a vibration speaker, which combines more functionality (e.g. loudspeaker functionality, vibration functionality, accelerometer functionality) into one single device as compared to some state of the art solutions. This may be advantageous in, e.g., a mobile phone application, where there is a continuing need towards both miniaturization and additional functions.

BRIEF DESCRIPTION OF THE DRAWINGS

Further objects, features and advantages of the present invention will appear from the following detailed description of embodiments of the invention, wherein embodiments of the invention will be described in more detail with reference to the accompanying drawings, in which.

DETAILED DESCRIPTION OF EMBODIMENTS OF THE INVENTION

Embodiments of the present invention will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference signs refer to like elements throughout.

The present disclosure relates to the field of electronic devices. A preferred embodiment of the invention relates to a portable communication device. In a best mode of the invention known to date, the invention can be implemented in a mobile phone. However, although the invention is particularly suitable for mobile phones, it is as such equally applicable to electronic devices which do not include radio communication capabilities. For example, the portable electronic device may be any portable electronic device such as, e.g., a communicator, a computer, a smart phone, an electronic organizer such as a Personal Digital Assistant (PDA), or an audio player such as an MP3-player or an iPod™. However, for the sake of clarity and simplicity, the embodiments outlined herein are related to mobile phones. Preferred embodiments will now be described with reference to the accompanying drawings.

Figure 1:
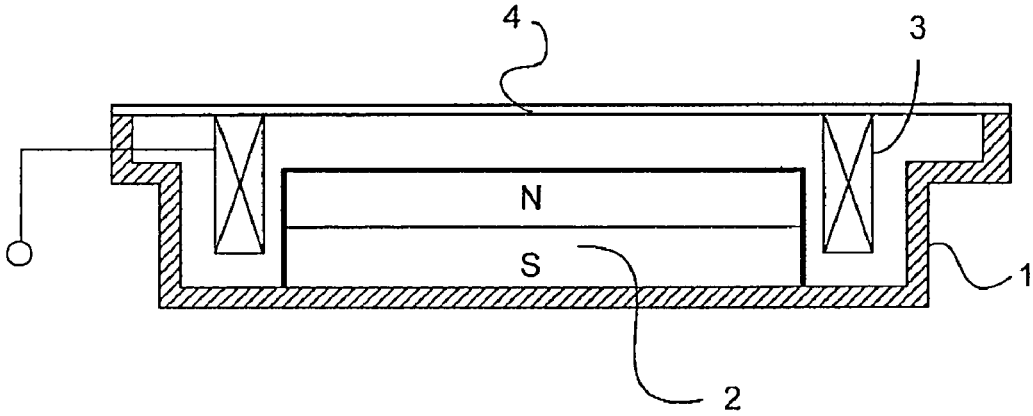
FIG. 1 (PRIOR ART)
FIG. 1 is a cross-sectional view from a side of a state of the art micro speaker.
Figure 2:
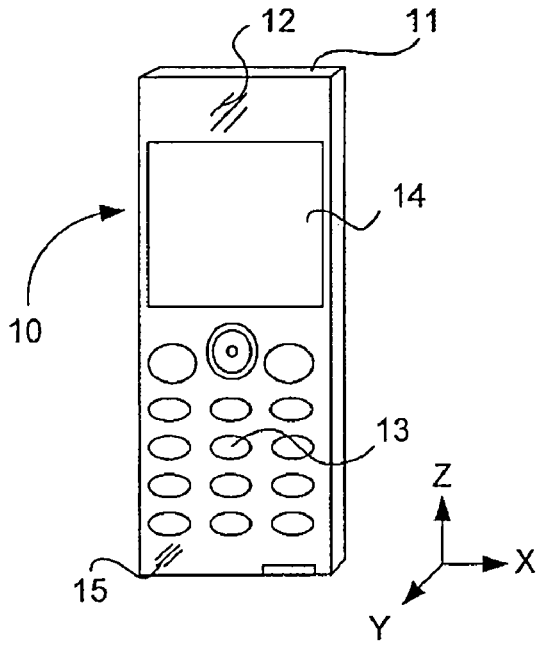
FIG. 2 schematically illustrates a front view of an electronic device in the form of a mobile phone.

A mobile phone 10 is shown in FIG. 2. The mobile phone 10 comprises a support structure 11 including a housing and a chassis arranged to support other elements of the mobile phone. The mobile phone illustrated in FIG. 2 comprises a vibration speaker 12 in accordance with an embodiment of the present invention, which will be described in greater detail hereinbelow. Furthermore, the mobile phone 1 includes a keypad or keyboard 13 and a display 14. Typically, the mobile phone 1 also includes a microphone 15. The mobile phone also comprises radio transceiver circuitry and antenna (not shown). The specific function and design of the mobile phone 10 as a communication device is known to persons skilled in the art, and will therefore not be described in any further detail herein. The list of features and elements included in the mobile phone 10 is in no way exhaustive. On the contrary, while the mobile phone 10 shown and described represents only one possible embodiment, it may well comprise further features and elements providing other functions. Also, it should be appreciated that some of the elements listed above are of little or no importance for the invention as such and can be dispensed with if the invention is employed in another electronic device, e.g. in a portable electronic organizer such as a PDA.

Exemplary embodiments of the vibration speaker 12 will now be described with reference made to FIGS. 3-5. The vibration speaker comprises a case 300. A loudspeaker member 310 for generating sound is positioned inside the case 300. The loudspeaker member 310 comprises a frame 311, a magnet 312, a voice coil 313 and a membrane 314, 514. The voice coil 313 is operable to generate a movement of said membrane 314, 514 alternately in two opposite directions (e.g. vertically up and down) when an electric current is applied to the voice coil 313 and whereby a magnetic field is formed by interaction between the voice coil 313 and the magnet 312. The vibration speaker further comprises a vibration coil 320 for generating a vibration. The vibration coil 320 is positioned in relation to said magnet 312 of the loudspeaker member 310 such that the vibration coil 320 is operable to generate a movement of the entire loudspeaker member 310 alternately in the mentioned two opposite directions when an electric current is applied to the vibration coil 320 and whereby a magnetic field is formed by interaction between the vibration coil 320 and the magnet 312. Moreover, at least one elastic member 330 is positioned to elastically support between the loudspeaker member 310 and the said case 300 when the entire loudspeaker member 310 is moved alternately in the mentioned directions.

Whereas the voice coil 313 is operable to drive the membrane 314, 514 of the loudspeaker member 310 as for a conventional loudspeaker so as to generate a sound, the vibration coil 320 is operable to drive the entire loudspeaker member. The entire loudspeaker member 310 may consequently be used as the moving mass for the vibration coil 320. This way, the vibration coil 320 is operable to displace a relatively large mass represented by the entire loudspeaker member 310, thus creating vibrations. Furthermore, the vibration coil may be used as a 1-axis accelerometer. The loudspeaker member 310 may be elastically connected to the main frame or case 300 only by the elastic member 330. Due to the mechanical construction (e.g. material, size, weight of different parts) of the loudspeaker member 310, this loudspeaker member 310 has a relatively large mass. Any displacement of the mobile phone 10 (including the vibration speaker 12) about an Z-axis (see FIG. 2) may cause the loudspeaker member 310 of the vibration speaker 12 to be displaced or moved accordingly relative to the case 300 of the vibration speaker 12. Reciprocally, this will generate a current in the vibration coil as this vibration coil 320 moves relative to the magnetic field. Hence, by measuring the voltage across the vibration coil 320 and comparing the measured voltage with predetermined voltage criteria, it may be possible to detect accelerations.

Figure 3:
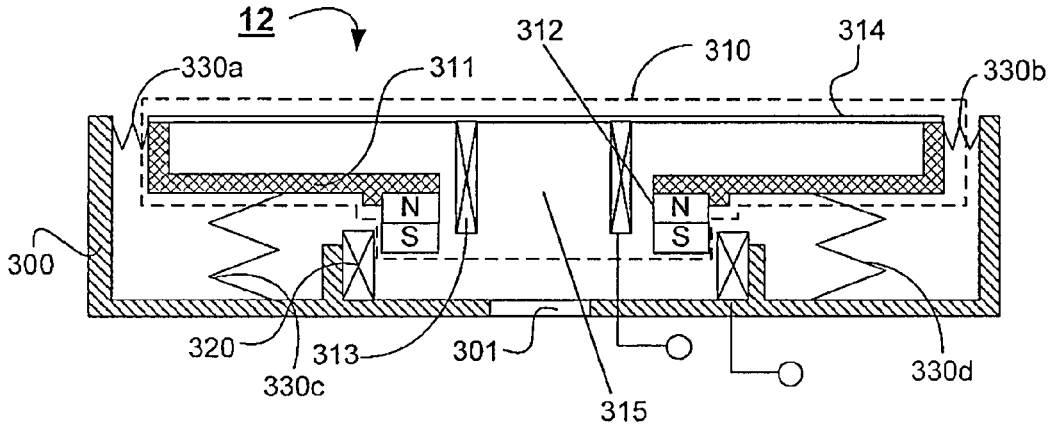
FIG. 3 is a cross-sectional view from a side of a vibration speaker according to an embodiment of the invention.

FIG. 3 illustrates a side cross-sectional view of a vibration speaker 12 according to an exemplary embodiment of the present invention. The vibration speaker 12 comprises a main frame or case 300. The case 300 may be a hollow box type case. As is illustrated in FIG. 3, the case 300 may have one or several openings 301 at a bottom side of the case 300 in order to allow adjustment of the acoustic impedance of the vibration speaker 12. The position of such openings 301 is not restricted to the case bottom surface but can be located at various positions of the case 300. Variations in the design of the case 300 and in the number and size of the openings 301 may allow for optimization of the loudspeaker frequency response for the vibration speaker 12. Therefore, it should be appreciated that the exact design and the number and size of the openings can be varied in dependence of the purpose of the vibration speaker 12 and this must hence be tested and evaluated in each specific case.

Inside the case 300 is contained a loudspeaker member 310. The loudspeaker member 310 may be positioned inside the case 300 in such way that the case 300, at least partly, encloses the loudspeaker member 310. The loudspeaker member 310 may be configured to operate substantially as a conventional loudspeaker and, as such, it may have a design substantially corresponding to that of a conventional loudspeaker. The loudspeaker member may hence constitute conventional parts of a loudspeaker. In FIG. 3, the loudspeaker member 310 comprises a frame 311, a magnet 312, a voice coil 313 and a membrane 314. The frame 311 may have a hole 315 at a bottom side of the frame 311. The magnet 312 may be affixed to the frame 311 at the hole 315. For example, the magnet 312 may be a magnet having a cylindrical shape, whose top part is cylindrically affixed to the bottom side of frame 311 such that the magnet 312 surrounds the hole 315, as is illustrated in FIG. 3. The outside edge part of membrane 314 is affixed to a top part of the frame 311 as is shown in FIG. 3. The voice coil 313 may be a coil wound in cylindrical shape, which is wound on a bobbin whose top part is attached to the membrane 314 bottom surface, to which coil an alternating electrical current can be applied from outside. As is illustrated in FIG. 3, the voice coil 313 may be positioned to extend from the membrane 314 bottom surface through the hollow interior of the loudspeaker member 310 and through the hole 315 of the frame 311. In this way, the magnet 312 and the voice coil 313 may be positioned in sufficient proximity to each other in order to form a magnetic circuit. The loudspeaker member 310 is operable to generate sound as voice coil 313 moves vertically up and down owing to a magnetic field formed by the interaction between voice coil 313 and magnet 312 if an electrical current is applied to voice coil 313. The electrical current may, e.g., be supplied through a lead wire from outside. The electrical current should, preferably, be a low-frequency electrical current, e.g. in the range of 20-100 Hz. It should, however, be appreciated that exact value of the frequency can be varied in dependence of the purpose of the vibration speaker 12 and this must hence be tested and evaluated in each specific case. As voice coil 313 moves up and down according to a magnetic field variation applied at voice coil 313, the membrane 314 attached to the voice coil 313 vibrates up and down to generate sound. In this way, the loudspeaker member 310, 410, 510 is operable to perform a sound function.

An elastic member 330 is positioned to elastically support between the loudspeaker member 310 and the case 300. That is, the loudspeaker member 310 is elastically mounted to the case 300 by means of one or several elastic members 330. In the embodiment shown in FIG. 3, the top part of the frame 311 is elastically attached to side walls of the case 300 by means of peripheral elastic members 330*a*, 330*b*. Furthermore, the bottom side of the frame 311 is elastically attached to the bottom side of the case 300 via bottom elastic members 330*c*, 330*d*. The elastic members may be made of metal springs as shown in FIG. 3. Alternatively, the elastic members may be made of blocks of rubber (not shown in the figures). As will be further explained below, the one or several elastic members 330 is configured to elastically support between the loudspeaker member 310 and the case 300 so that the loudspeaker member 310 may move vertically up and down within the case 300.

The vibration speaker 12 further comprises a vibration coil 320. The dimensions of the vibration coil 320 may be comparatively larger than the dimensions of the voice coil 313, since as will be described hereinbelow the mass to be displaced by the vibration coil 320 is larger. The magnet 312 and the vibration coil 320 can be positioned in sufficient proximity to each other in order to form a magnetic circuit together. As is illustrated in FIG. 3, the vibration coil 320 may be mounted on the bottom side of the case 300 underneath the bottom side of frame 311 of the loudspeaker member 310. The vibration coil 320 may thus face the bottom side of the frame 311 of the loudspeaker member 310. The vibration coil 320 may be a coil wound in cylindrical shape, which is wound on a bobbin whose bottom part is attached to the bottom surface of the case 300, to which vibration coil 320 an alternating electrical current can be applied. Upon application of an alternating electrical current, the vibration coil 320 is operable to generate a vertical force causing a movement of the entire loudspeaker member 310 (i.e. including the frame 311, the magnet 312, the voice coil 313 and the membrane 314) vertically up and down, whereby the elastic members 330*a-d* are configured to elastically support between the loudspeaker member 310 and the case 300 during the vertical movement. Consequently, the movement of the loudspeaker member 310 results in a displacement of the loudspeaker member 310 relative to the case 300 of the vibration speaker 12. The mass of the loudspeaker member 310 is relatively large, mainly due to the frame 311 and the magnet 312 mounted on the frame 311. By periodically displacing this relatively large mass, a vibration may be created. Again, the electrical current should, preferably, be a low-frequency electrical current, e.g. in the range of 20-100 Hz. It should, however, be appreciated that exact value of the frequency can be varied in dependence of the purpose of the vibration speaker 12 and this must hence be tested and evaluated in each specific case. The entire loudspeaker member 310 may hence be used as the moving mass for the vibration coil 320. The thus created vibrations may be felt by a user operating the mobile phone 10 incorporating the vibration speaker 12. In order to obtain an advantageous displacement of the loudspeaker member which generates a user-detectable vibration, the frequency of the applied alternating electrical current could, preferably, be chosen to be close to the resonance frequency. This resonance frequency is, inter alia, dependent on the resilient properties of the elastic members 330*a-d* and on the moving mass (i.e. the loudspeaker member 310). Therefore, it should be appreciated by those skilled in the art that the resonance frequency may be varied in dependence of the purpose of the vibrator speaker design and this must hence be tested and evaluated in each specific case. A typical range of the resonance frequency in mobile phone application may, as an example, be about 100-200 Hz.

It will be appreciated from the above discussion that the vibration speaker 12 is operable to perform not only a loudspeaker function but also a vibration function. The voice coil 313 and the vibration coil 320 could be fed with alternating electrical current either separately or simultaneously. Accordingly, the vibration speaker could be used for performing the loudspeaker function and the vibration function either separately or simultaneously. Simultaneously performing both the loudspeaker function and the vibration function may be advantageous for some applications of the mobile phone 10 incorporating the vibration speaker 12. For example, in some mobile phone applications this may allow for simultaneously playing a ringtone and creating a vibration when a call is received from a remote calling party. It goes without saying that the same applies for, e.g., incoming SMS messages, MMS messages, etc. Also, the simultaneous performance of both the loudspeaker function and the vibration function could be used in alarm clock functionality or for alerting the user of a low level of battery power of the portable electronic device in question, etc.

Additionally, the vibration speaker 12 is operable to perform an accelerometer function. Upon the application of the alternating electrical current at the vibration coil 320, the vibration coil 320 may generate a vertical force causing a movement of the entire loudspeaker member 310 vertically up and down as described previously. Since the weight of the loudspeaker member 310 is relatively large, and since there is an elastic suspension between this loudspeaker member 310 and the case 300 by means of the elastic members 330, any acceleration provided to the case in the direction perpendicular to the vibration speaker 12 may result in a displacement of the loudspeaker member 310 relative to the case, as a consequence of the principle of inertia. Reciprocally, this may generate a current in the vibration coil as this vibration coil 320 moves relative to the magnetic field. Hence, by measuring the voltage across the vibration coil 320 and comparing the measured voltage with predetermined voltage criteria, it may be possible to detect accelerations. Consequently, the vibration speaker may be operable to perform a 1-axis accelerometer function. In one possible implementation of the accelerator function, the vibration speaker 12 may be electrically coupled to an accelerometer unit, including a voltage measuring unit adapted to measure the voltage across the vibration coil 320, wherein the voltage across said vibration coil 320 is representative of the displacement/acceleration of the loudspeaker member 310 relative to the case 300, and a comparator unit adapted to compare the measured voltage with predetermined voltage criteria for establishing whether or not the loudspeaker member 310 is displaced relative to the case 300.

Figure 4:
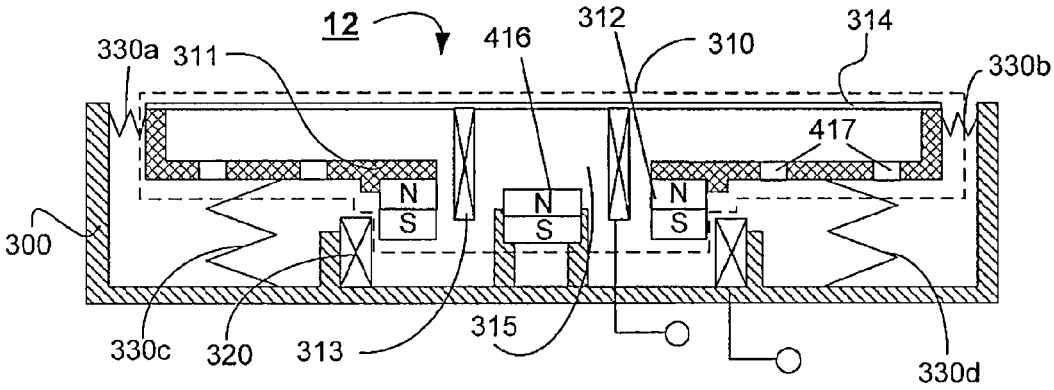
FIG. 4 is a cross-sectional view from a side of a vibration speaker according to another embodiment of the invention.

FIG. 4 illustrates a side cross-sectional view of a vibration speaker 12 according to another embodiment of the present invention. This embodiment is similar to that previously described with reference to FIG. 3 and has substantially the same or similar effects and advantages as the previously described embodiment. Therefore, like elements refers to like reference signs. The embodiment shown in FIG. 4 differs from that of FIG. 3 inter alia in that it additionally comprises a further magnet 416 and in that the frame 311 comprises frame openings 417. The magnet 416 may be a magnet being mounted on the bottom side of the case 300. As is illustrated in FIG. 4, the further magnet 416 may be positioned in a central part of the bottom side of the case 300. As such, it may be positioned underneath the hole 315 of the frame 311. Preferably, but not necessarily, the voice coil 313 is positioned such that at least a portion of its bottom portion facing the bottom side of the case 300 cylindrically surrounds the further magnet 416. The further magnet 416 and the voice coil 313 are positioned in sufficient proximity to each other for forming a magnetic circuit. In this embodiment, the voice coil 313 may, hence, be surrounded by a magnetic field created by the combination of magnet 312 and the further magnet 416. The frame 311 may be provided with one or several frame openings 417 in order to allow air to circulate within the vibration speaker 12. The position of such frame openings 417 is not restricted to the frame 311 bottom surface but can be located at various positions of the frame 311. Variations in the design of the case frame and in the number and size of the frame openings 417 may allow for optimization of the air circulation for the vibration speaker 12. Therefore, it should be appreciated that the exact design and the number and size of the frame openings 417 can be varied in dependence of the purpose of the vibration speaker 12 and this must hence be tested and evaluated in each specific case.

Figure 5:
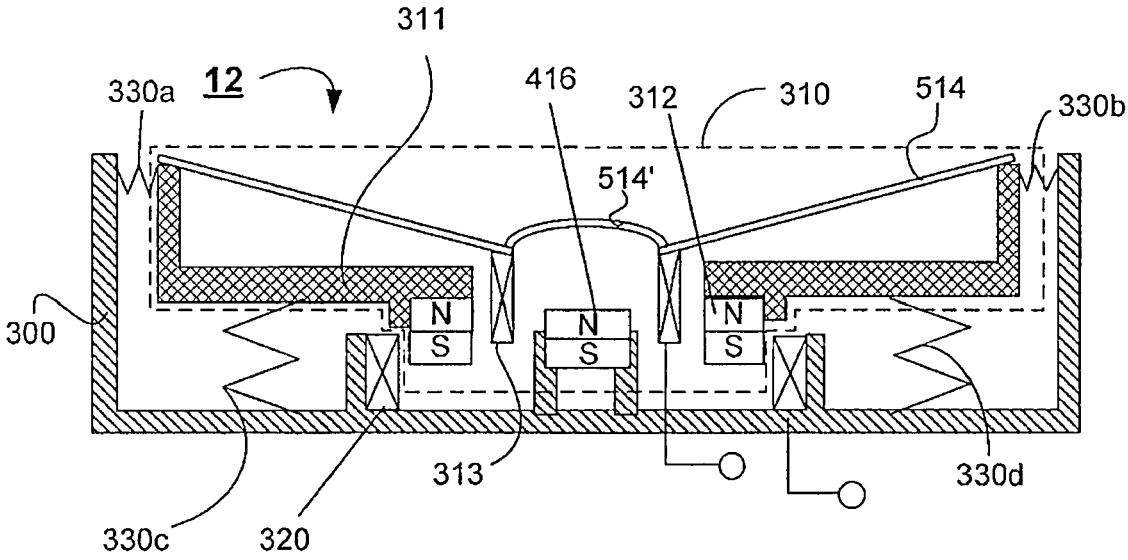
FIG. 5 is a cross-sectional view from a side of a vibration speaker according to another embodiment of the invention.

FIG. 5 illustrates a side cross-sectional view of a vibration speaker 12 according to still another embodiment of the present invention. This embodiment is similar to that previously described with reference to FIG. 4 and merely differs in that the membrane 514 has a different shape than that shown in FIG. 4. The membrane 514 comprises a membrane dome 514' in a center portion of the membrane 514. This embodiment has substantially the same or similar effects and advantages as the previously described embodiment and therefore this embodiment will not be further explained here.

Some embodiments of the present invention provide a vibration speaker, which is smaller in size as compared to some state of the art solutions. A typical size of the vibration speaker 12 shown in FIGS. 3-5 may, e.g., be 5 mm*10 mm*20 mm. It should however be noted that the size may also be somewhat larger in some embodiments, e.g., 10-25% larger than the above-mentioned size. However, the vibration speaker 12 according to the embodiments of the invention may, nevertheless, assume a smaller dimension as compared to a prior art solution where the different functionalities are provided by separate devices for each of the different functionalities (e.g. sound function, vibration function and/or accelerometer function). Some embodiments of the invention are different from existing solutions inter alia in that they assume the use of the entire loudspeaker member (i.e. incl. the frame, the magnet, the membrane, and the voice coil) as the moving mass for the vibration coil to generate a vibration. It is an advantage with some embodiments of the invention that they provide a vibration speaker that may allow for a combined movement of both the membrane relative to the loudspeaker member as well as a movement of the entire loudspeaker member relative to the case of the vibration speaker. In turn, this may allow for an extension of the possible displacement range of the voice coil of the loudspeaker member. This may allow for an enhanced response in the bass register, where prior art solutions generally do not reproduce deep sound. Moreover, some embodiments of the invention provide a vibration speaker, which combines more functionality (e.g. loudspeaker functionality, vibration functionality, accelerometer functionality) into one single device as compared to state of the art solutions. This may be advantageous in e.g. a mobile phone application, where there is a continuing need towards both miniaturization and additional functions. Furthermore, some embodiments of the present invention may allow for an improved frequency response at lower frequencies, which might be used in music applications of portable electronic devices such as mobile phones.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The foregoing has described the principles, the various embodiments and a mode of operation of the present invention. The detailed description of the preferred and disclosed embodiments should be regarded as illustrative rather than restrictive, and not as being limited to the particular embodiments discussed. For example, the list of features and elements included in the vibration speaker 12 shown in FIGS. 3-5 is not exhaustive. Rather, while the vibration speaker 12 described in conjunction with FIGS. 3-5 represent only possible embodiments, it may well comprise additional features and elements providing other functions or technical effects. The various features of the different embodiments can be combined in other combinations than those explicitly described herein. It should therefore be appreciated that variations may be made by those skilled in the art without departing from the scope of the present invention as defined by the appended claims.

What is claimed is:

1. A vibration speaker for a portable electronic device, wherein the vibration speaker comprises:

a case;

a loudspeaker member for generating a sound, the loudspeaker member being positioned inside the case and comprising a frame, a magnet, a voice coil and a membrane, wherein the voice coil is positioned to generate a movement of the membrane alternately in two opposite directions when an electric current is applied to the voice coil and a magnetic field is formed by interaction between the voice coil and the magnet;

a vibration coil for generating a vibration, the vibration coil being positioned inside the case and further being positioned to generate a movement of the entire loudspeaker member alternately in the mentioned two opposite directions when an electric current is applied to the vibration coil and a magnetic field is formed by interaction between the vibration coil and the magnet, and at least one elastic member being positioned to elastically support between the loudspeaker member and the case when the entire loudspeaker member is moved alternately in the mentioned directions;

wherein the magnet is attached to a bottom side of the frame, an outside edge part of the membrane is affixed to a top part of the frame, and the voice coil is attached to the membrane;

wherein the at least one elastic member comprises a plurality of elastic members, and wherein, the frame is elastically mounted to the case by means of said plurality of elastic members;

wherein the frame is elastically mounted to both side walls and a bottom side of the case by means of said plurality of elastic members.

2. The vibration speaker as recited in claim 1, wherein the case is a hollow box type case.

3. A vibration speaker for a portable electronic device, wherein the vibration speaker comprises:

a case;

a loudspeaker member for generating a sound, the loudspeaker member being positioned inside the case and comprising a frame, a magnet, a voice coil and a membrane, wherein the voice coil is positioned to generate a movement of the membrane alternately in two opposite directions when an electric current is applied to the voice coil and a magnetic field is formed by interaction between the voice coil and the magnet;

a vibration coil for generating a vibration, the vibration coil being positioned inside the case and further being positioned to generate a movement of the entire loudspeaker member alternately in the mentioned two opposite directions when an electric current is applied to the vibration coil and a magnetic field is formed by interaction between the vibration coil and the magnet, and at least one elastic member being positioned to elastically support between the loudspeaker member and the case when the entire loudspeaker member is moved alternately in the mentioned directions;

wherein the magnet is attached to a bottom side of the frame, an outside edge part of the membrane is affixed to a top part of the frame, and the voice coil is attached to the membrane;

wherein the voice coil is a coil wound in cylindrical shape, which is wound on a bobbin whose top part is attached to a bottom surface of the membrane, and wherein the voice coil extends from the bottom surface of the membrane through a hollow interior of the loudspeaker member and through the hole of the frame, the magnet and the voice coil thereby being positioned to form a magnetic circuit together.

4. The vibration speaker as recited in claim 3, wherein the case is a hollow box type case.

5. A vibration speaker for a portable electronic device, wherein the vibration speaker comprises:

a case;

a loudspeaker member for generating a sound, the loudspeaker member being positioned inside the case and comprising a frame, a magnet, a voice coil and a membrane, wherein the voice coil is positioned to generate a movement of the membrane alternately in two opposite directions when an electric current is applied to the voice coil and a magnetic field is formed by interaction between the voice coil and the magnet;

a vibration coil for generating a vibration, the vibration coil being positioned inside the case and further being positioned to generate a movement of the entire loudspeaker member alternately in the mentioned two opposite directions when an electric current is applied to the vibration coil and a magnetic field is formed by interaction between the vibration coil and the magnet, and at least one elastic member being positioned to elastically support between the loudspeaker member and the case when the entire loudspeaker member is moved alternately in the mentioned directions;

wherein the magnet is attached to a bottom side of the frame, an outside edge part of the membrane is affixed to a top part of the frame, and the voice coil is attached to the membrane;

wherein the at least one elastic member comprises a plurality of elastic members, and wherein, the frame is elastically mounted to the case by means of said plurality of elastic members; and wherein the vibration speaker comprises a further magnet, the further magnet being attached to a bottom side of the case and being positioned underneath a hole of the bottom side of the frame such that the voice coil can be surrounded by a magnetic field formed by interaction between the voice coil and the combination of said magnet and said further magnet.

6. The vibration speaker as recited in claim 5, wherein the case is a hollow box type case.

7. A vibration speaker for a portable electronic device, wherein the vibration speaker comprises:

a case;

a loudspeaker member for generating a sound, the loudspeaker member being positioned inside the case and comprising a frame, a magnet, a voice coil and a membrane, wherein the voice coil is positioned to generate a movement of the membrane alternately in two opposite directions when an electric current is applied to the voice coil and a magnetic field is formed by interaction between the voice coil and the magnet;

a vibration coil for generating a vibration, the vibration coil being positioned inside the case and further being positioned to generate a movement of the entire loudspeaker member alternately in the mentioned two opposite directions when an electric current is applied to the vibration coil and a magnetic field is formed by interaction between the vibration coil and the magnet, and at least one elastic member being positioned to elastically support between the loudspeaker member and the case when the entire loudspeaker member is moved alternately in the mentioned directions;

wherein the magnet is attached to a bottom side of the frame, an outside edge part of the membrane is affixed to a top part of the frame, and the voice coil is attached to the membrane;

wherein the at least one elastic member comprises a plurality of elastic members, and wherein, the frame is elastically mounted to the case by means of said plurality of elastic members; and wherein the vibration coil is attached to a bottom side of the case and a top part of said vibration coil faces the bottom side of the frame of the loudspeaker member.

8. The vibration speaker as recited in claim 7, wherein the vibration coil is a coil wound in cylindrical shape, which is wound on a bobbin whose bottom part is attached to a bottom side of the case.

9. The vibration speaker as recited in claim 7, wherein the case is a hollow box type case.

10. A vibration speaker for a portable electronic device, wherein the vibration speaker comprises:

a case;

a loudspeaker member for generating a sound, the loudspeaker member being positioned inside the case and comprising a frame, a magnet, a voice coil and a membrane, wherein the voice coil is positioned to generate a movement of the membrane alternately in two opposite directions when an electric current is applied to the voice coil and a magnetic field is formed by interaction between the voice coil and the magnet;

a vibration coil for generating a vibration, the vibration coil being positioned inside the case and further being positioned to generate a movement of the entire loudspeaker member alternately in the mentioned two opposite directions when an electric current is applied to the vibration coil and a magnetic field is formed by interaction between the vibration coil and the magnet, and at least one elastic member being positioned to elastically support between the loudspeaker member and the case when the entire loudspeaker member is moved alternately in the mentioned directions;

the vibration speaker being electrically coupled to an accelerometer unit, which comprises:

a voltage measuring unit adapted to measure a voltage across said vibration coil, the voltage across said vibration coil being representative of a displacement of the loudspeaker member relative to the case; and a comparator unit adapted to compare the measured voltage with predetermined voltage criteria for establishing whether the loudspeaker member is displaced relative to the case.

11. The vibration speaker as recited in claim 10, wherein the case is a hollow box type case.

* * * * *